US007836829B2

(12) United States Patent
Burger

(10) Patent No.: US 7,836,829 B2
(45) Date of Patent: Nov. 23, 2010

(54) RAIL-BOUND VEHICLE FOR AN AMUSEMENT PARK RIDE

(75) Inventor: Günter Burger, Waldkirch (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 19 days.

(21) Appl. No.: 11/984,118

(22) Filed: Nov. 14, 2007

(65) Prior Publication Data

US 2008/0110366 A1 May 15, 2008

(30) Foreign Application Priority Data

Nov. 15, 2006 (DE) ..... 10 2006 054 116

(51) Int. Cl.
*B60L 13/04* (2006.01)

(52) U.S. Cl. ..... 104/281; 104/250; 104/249; 104/282; 104/284

(58) Field of Classification Search ..... 104/249, 104/250, 281–294
See application file for complete search history.

(56) References Cited

U.S. PATENT DOCUMENTS

| | | | | |
|---|---|---|---|---|
| 3,554,130 | A * | 1/1971 | Broggie et al. | 104/75 |
| 3,583,328 | A * | 6/1971 | Schellentrager | 104/295 |
| 3,709,383 | A * | 1/1973 | Jennings et al. | 414/279 |
| 3,903,808 | A * | 9/1975 | Foldes | 104/288 |
| 4,217,829 | A * | 8/1980 | Heidelberg | 104/281 |
| 4,324,185 | A * | 4/1982 | Vinson | 104/283 |
| 5,174,215 | A * | 12/1992 | Barrows | 104/288 |
| 6,460,466 | B1 * | 10/2002 | Stoll et al. | 104/281 |
| 6,510,799 | B2 * | 1/2003 | Lamb et al. | 104/281 |
| 7,204,192 | B2 * | 4/2007 | Lamb et al. | 104/282 |
| 2005/0274278 | A1 * | 12/2005 | Thieltges | 104/292 |
| 2008/0110366 | A1 * | 5/2008 | Burger | 104/74 |
| 2008/0139328 | A1 * | 6/2008 | Burger | 472/129 |

FOREIGN PATENT DOCUMENTS

| | | |
|---|---|---|
| DE | 205596 | 11/1907 |
| DE | 92 10 125 U1 | 6/1993 |
| DE | 195 25 429 A1 | 1/1997 |
| DE | 198 35 236 A1 | 2/2000 |
| DE | 102 45 147 A1 | 4/2004 |
| DE | 202 80 207 U1 | 7/2004 |
| GB | 499431 | 1/1939 |

* cited by examiner

*Primary Examiner*—S. Joseph Morano
*Assistant Examiner*—Jason C Smith
(74) *Attorney, Agent, or Firm*—The Nath Law Group; Jiaxiao Zhang; Jerald L. Meyer

(57) ABSTRACT

The invention relates to a rail-bound vehicle for an amusement park ride. The vehicle has an upper part 10 with vehicle seats 12, as well as a carriage 20 whose running wheels 22 and lateral wheels 23 run on rail-tubes, as do its lift-off rollers 24. The upper part 10 can rotate freely around a vertical axis 16 relative to the carriage 20. A brake disk 14' made of a metallic material is provided on the underside of the upper part 10. Permanent magnets 31 connected to the rail system are assigned to this brake disk 14'. The brake disk 14, upon passing these permanent magnets 31, enters the latter's magnet field, with the result that the upper part 10 of the vehicle is braked and set into rotational motion due to the continued linear movement of the carriage 20.

20 Claims, 4 Drawing Sheets

RAIL-BOUND VEHICLE FOR AN AMUSEMENT PARK RIDE

Figure 1:
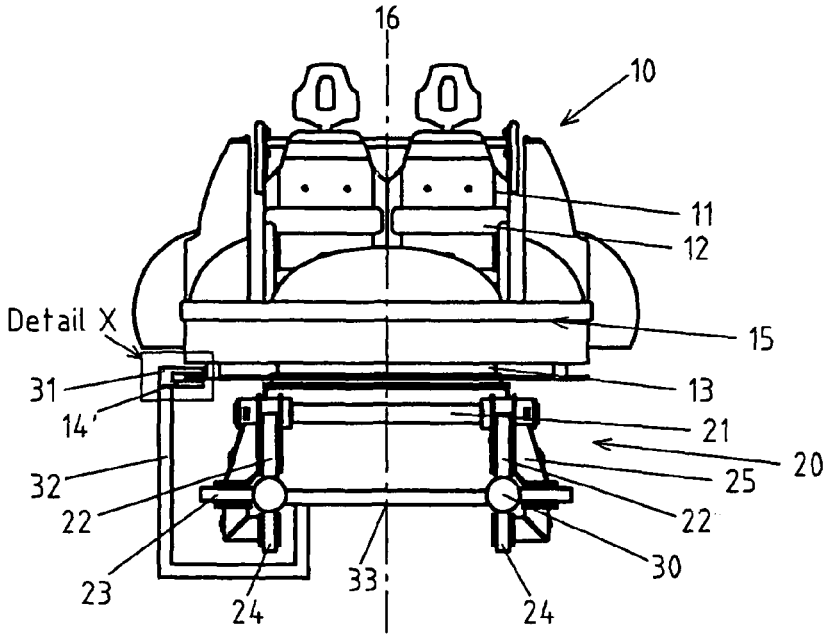

The invention relates to a rail-bound vehicle for an amusement park ride.

The invention is based on the amusement park ride known from DE 195 25 429 C3.

The cited ride involves vehicles which are guided on rails and which basically consist of a carriage that moves in the direction of the rails and an upper carriage or upper body which is swivel-mounted on the carriage, while the center of gravity of the upper carriage is eccentrically positioned, at a distance from the vertical axis of rotation. During travel on the track rails and while passing over curves, the upper carriage experiences a centrifugal force due its eccentric mounting, and this causes the upper carriage to execute a turning motion around its axis. To control the relatively complicated turning movement it is necessary to provide cushioning devices using viscous or frictional cushioning or employing an eddy current.

The present invention proposes a simpler solution, one which deliberately abandons the eccentric mounting of the upper carriage (which is somewhat problematic) and thus also abandons a rotating drive that utilizes centrifugal forces.

In accordance with the solution, there is assigned to the upper part of the vehicle a magnetic system which consists of at least one magnet and of one metallic braking element passing through the magnetic field of the magnet and preferably consisting of aluminum or brass. The magnet is firmly positioned in the area of the track, while the braking element is connected to the upper part of the vehicle. Upon locomotion of the vehicle, the magnetic system generates a decelerating impulse that works on the upper part, as based on the operating principle of an eddy-current brake, and the upper part consequently experiences an angular momentum.

To be sure, the use of a magnet to actively set the passenger-carriers of a carousel into circular motion is known from DE 205 596 A.

In this carousel, however, unlike the ride according to the invention, the circular motion of the passenger-carrier, and thus the upper part, is not derived from the linear motion of the vehicle.

As with a roller coaster, the vehicle according to the invention may be driven by gravity or by a motor.

The same effect can be achieved when, conversely, braking elements are firmly positioned in the area of the rail path and the magnet is connected to the upper part.

The magnetic system can either be controlled in programmed fashion as a function of the vehicle's position or can be actively controlled by a passenger seated in the vehicle. In this manner, the time and place, or the direction and speed of rotation, can be influenced.

If the magnetic system has permanent magnets, it is possible to realize the elucidated control system by positioning the magnet such that the magnet can be moved out of the path of the braking element, preferably by swiveling.

If, the magnet is an electromagnet, the control system can be realized with the current fed to its excitation coil.

In an exemplary embodiment of, the braking element is positioned on the underside of the vehicle's upper part, while stationary magnets are positioned in the area of the rail track, in the path of this braking element.

Embodiments of this braking element in the form of a disk or a ring include: wherein the disk or ring is circular or oval in shape, wherein the disk exhibits radially projecting segments, wherein the disk or ring is positioned eccentric to the rotating axis of the upper part, and wherein the disk or ring exhibits indentations.

While a circular or annular braking element provides uniform deceleration of the vehicle's upper part, a design deviating from a circular shape provides a predefined orientation, e.g., in the area of slow sections of travel or in the train station. It is advantageous, therefore, if the upper part of the vehicle occupies a position—e.g., while in the station area—which permits the passenger to enter and exit the vehicle, or at least makes the process easier.

The system according to the invention, as well as further details of the invention which are the subject matter of the claims, are next described in greater detail on the basis of exemplary embodiments, which are schematically depicted in the drawings. Shown in the drawings are:

FIG. 1 front view of a vehicle located on the track

Figure 2:
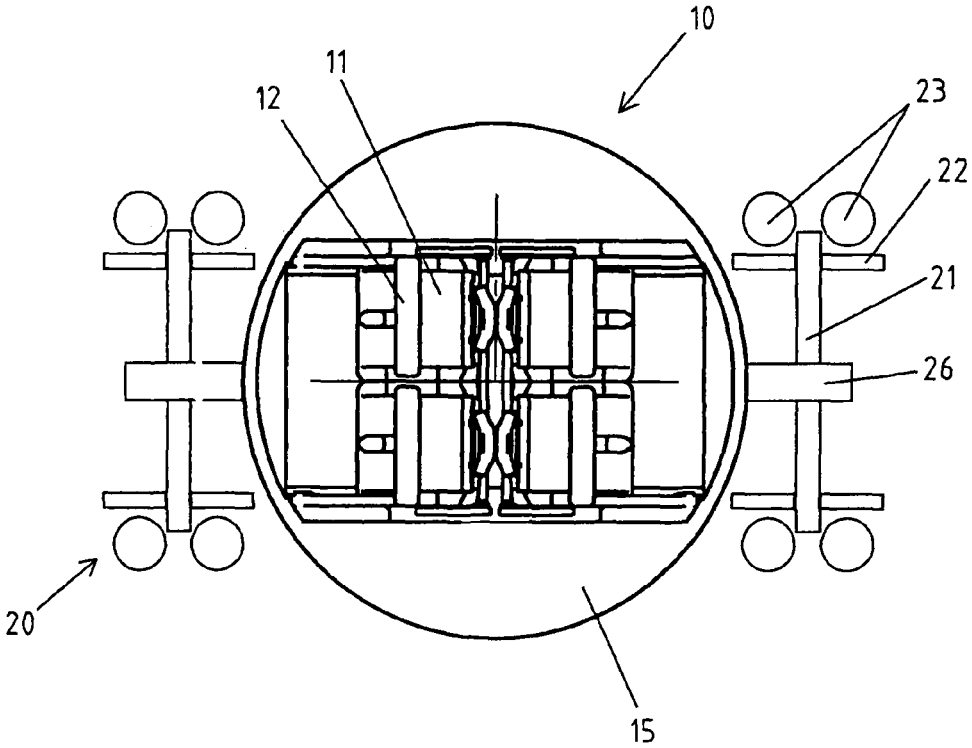

FIG. 2 top view of the vehicle of FIG. 1

Figure 3:
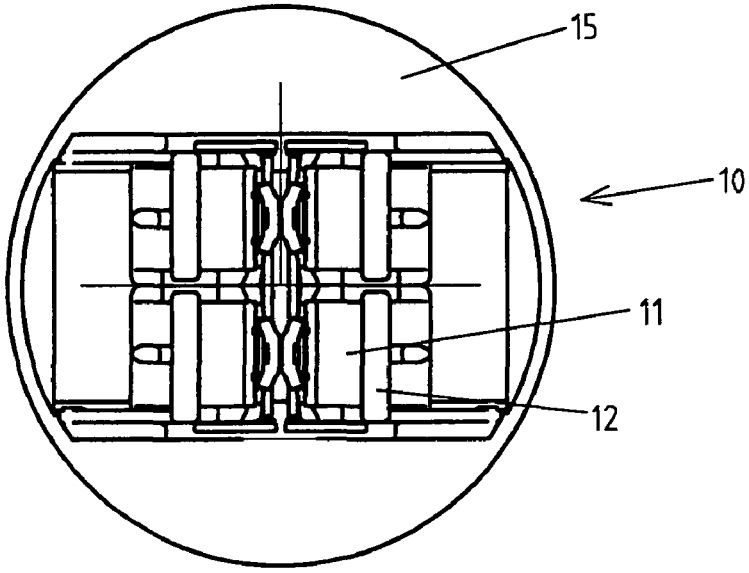

FIG. 3 top view of the upper part of the vehicle

Figure 4:
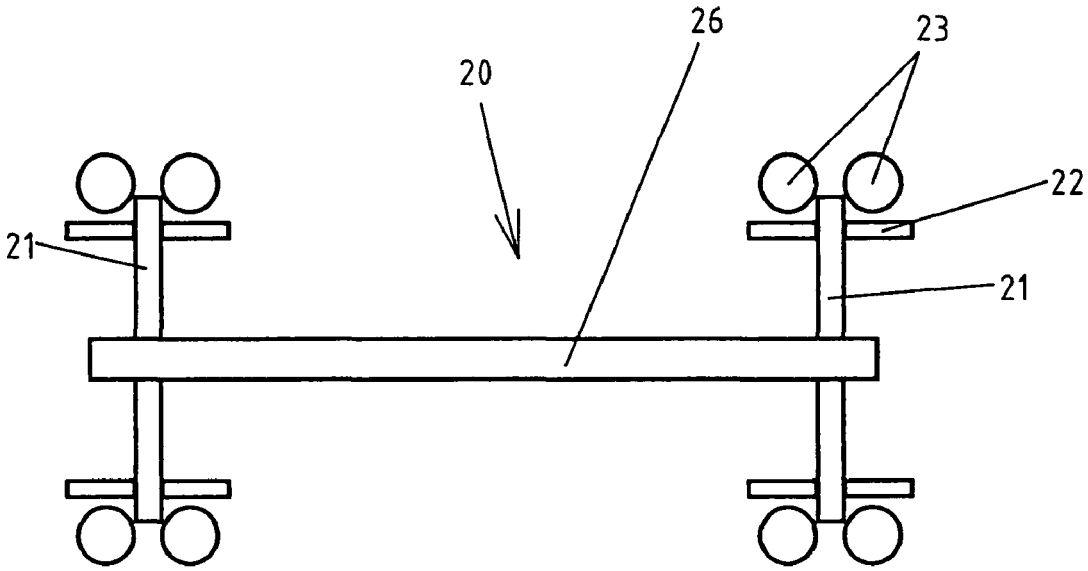

FIG. 4 top view of the carriage

Figure 5:
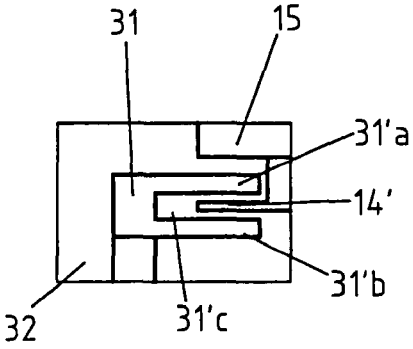
Figure 6:
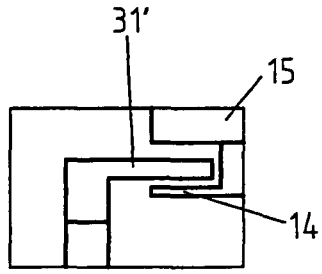

FIG. 5 enlarged view of detail V in FIG. 1, specifically the eddy-current brake FIG. 6 second exemplary embodiment of an eddy-current brake, in a depiction like that of FIG. 5

Figure 7:
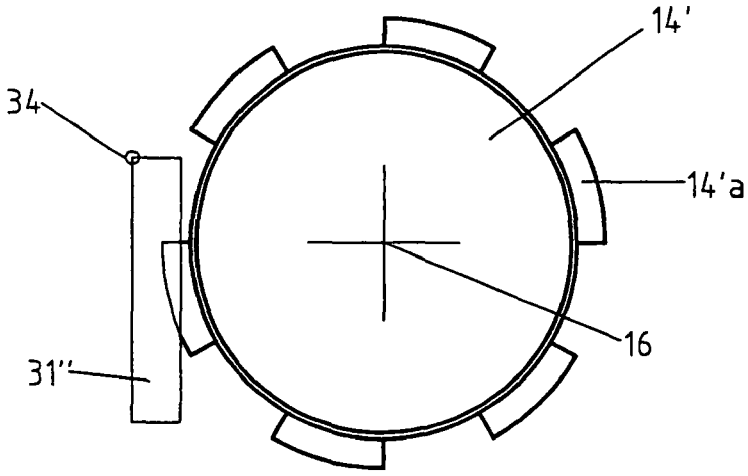
Figure 8:
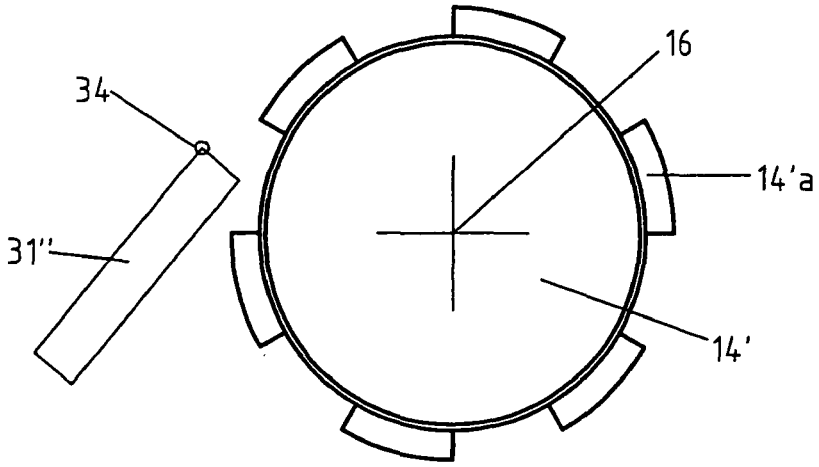

FIGS. 7 and 8 top view of a segmented brake disk, with a permanent magnet that can be swiveled into two positions FIGS. 9 to 12 top views of brake rings in four different designs FIGS. 1 and 2 show a vehicle equipped with a magnetic braking system in accordance with the invention, for travel on rail tubes 30, in an amusement park ride that is not depicted in detail, e.g., like that of a roller coaster.

The vehicle consists of an upper part 10, with passenger seats 11 and with retainer systems 12 assigned to them. These parts are positioned on a circular platform 15, which can freely rotate relative to the carriage 20, around a perpendicular axis 16, which is indicated by the segmented line in FIG. 1.

The carriage consists of a frame, which is not depicted in detail, but which can be more closely identified in FIG. 4. The frame exhibits vehicle axles 21, which run on the perpendicular, and one main beam 26. The vehicle axles 21 support wheelhouses 25, and running wheels 22 are swivel-mounted on these wheelhouses 25, as are side wheels 23 and lift-off rollers 24, which operate at the front to prevent lifting.

The running wheels 22 and side wheels 23, as well as the lift-off rollers 24, are positioned perpendicular to each other and move on the surface of the rail tubes 30. Transverse members 33 serve to stabilize the rail system.

On its underside the platform 15 of the upper part 10 exhibits a rotating seat 13, which in turn is equipped with a metal brake disk 14' on the side facing the carriage 20. This brake disk 14' has radially projecting segments 14'*a*, which are distributed over its circumference. Assigned to the brake disk 14', with segments 14'*a*, is a permanent magnet 31, which is supported by a magnet holder 32 connected to one of the transverse members 33 of the rail system.

The magnetic brake system consisting of brake disk 14' and permanent magnet 31 is next explained in greater detail on the basis of the enlarged depiction provided by FIG. 5. In this embodiment the permanent magnet 31' has two pole shoes 31*a* and 31*b*, which border an air gap 31*c*. The brake disk 14', which is firmly connected to the upper part 10 of the vehicle, dips into this air gap 31*c*, and an eddy current is consequently produced in the brake disk 14' due to induction. This leads to the vehicle upper part 10 being braked, in keeping with the operating system for an eddy-current brake. Since the vehicle continues to move in the longitudinal direction, braking causes the upper part 10 of the vehicle to rotate.

A somewhat different design for the permanent magnet 31' is shown in FIG. 6. Here the permanent magnet 31' has only one pole shoe.

The same effect can be achieved by providing electromagnets in place of the permanent magnets. These electromagnets can be controlled by changing the coil current, as dependent on the program that is provided; or they can be interactively controlled by the passenger.

To control the magnetic system operating with permanent magnets the arrangement depicted in FIGS. 7 and 8 is proposed as exemplary. Here there is assigned to the circulating brake disk 14' a permanent magnet 31", which swivels around the axis 34, so that it can be brought from the position shown in FIG. 7 to that shown in FIG. 8. The magnetic system is thus controlled in a purely mechanical manner.

Figure 9:
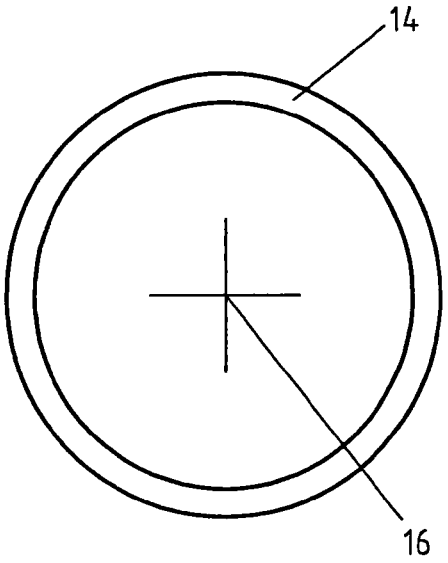

Various design possibilities for the brake disk or brake ring are depicted in FIG. 9 to 12. The simplest form for a brake ring 14 is depicted in FIG. 9. When this brake ring 14 enters the magnetic field of the permanent magnet (not depicted) the result is a uniform deceleration.

Figure 10:
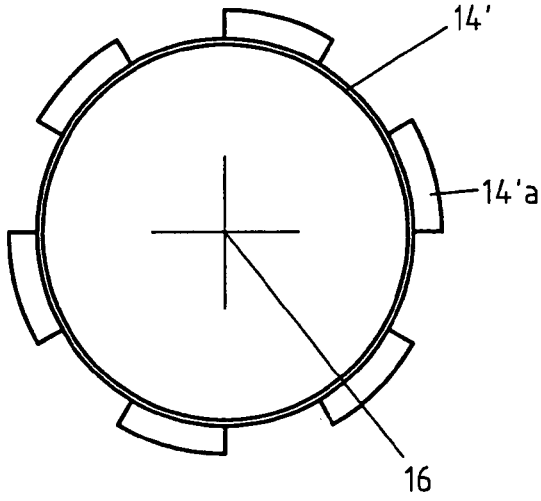

FIG. 10 shows the exemplary embodiment of a brake disk 14' with radially projecting segments 14'*a* distributed over the circumference; here brake deceleration is only achieved when the segments 14'*a* enter the magnetic field of the permanent magnet. This allows the realization of preferred orientations for the upper part of the vehicle.

Figure 11:
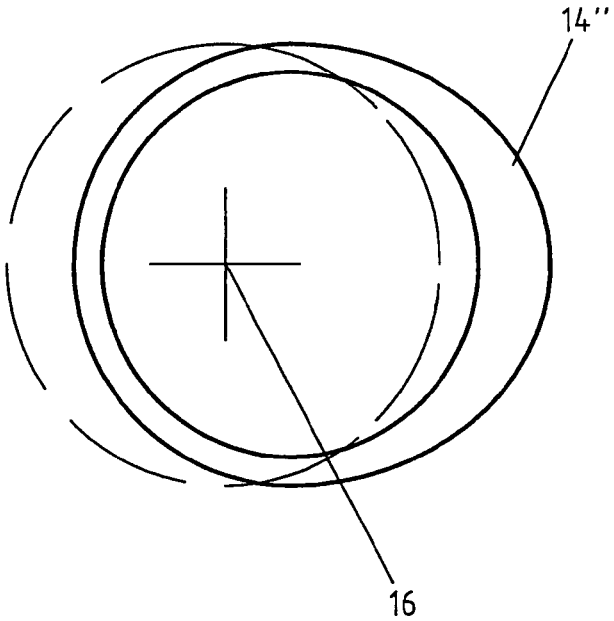

For continuous modification of the braking effect, a comparable effect can be achieved with a brake disk 14" that is positioned eccentric to the rotating axis 16, as is shown in FIG. 11.

Figure 12:
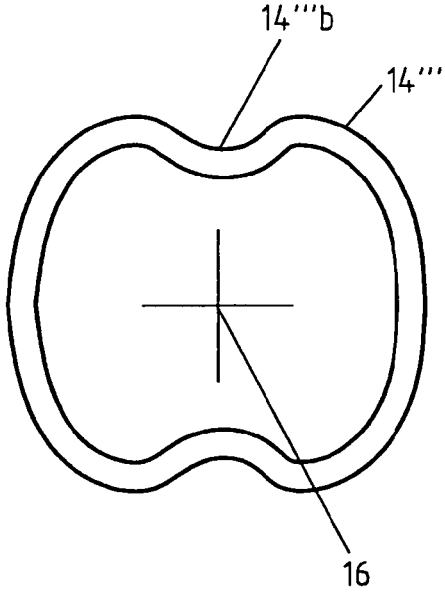

In another exemplary embodiment, shown in FIG. 12, the brake disk 14'", which is roughly oval in shape, exhibits indentations 14'"b. These indentations give the upper part 10, which rotates relative to the carriage 20, a preferred position when there is again a continuously changing effect.

LIST OF REFERENCE NUMERALS

| | |
|---|---|
| 10 | upper part |
| 11 | passenger seats |
| 12 | retainer systems |
| 13 | rotating seat |
| 14, 14' | brake disk |
| 14", 14'" | |
| 14'a | segments |
| 14'"b | indentation |
| 15 | platform |
| 16 | rotating axis |
| 20 | carriage |
| 21 | carriage axle |
| 22 | running wheels |
| 23 | side wheels |
| 24 | lift-off rollers |
| 25 | wheelcases |
| 26 | main beam of frame |
| 30 | track tube |
| 31, 31', 31" | permanent magnet |
| 31a, b | pole shoes |
| 31c | air gap |
| 32 | magnet holder |
| 33 | transverse member |
| 34 | pivot point |

The invention claimed is:

1. Rail-bound amusement park ride vehicle comprising:

a carriage that travels in the direction of the rails; and an upper platform/seat that rotates freely in relation to the carriage, wherein the upper platform/seat comprises a magnetic system consisting of at least one magnet and one metallic braking element that runs through the magnetic field of the magnet, wherein the magnetic system has a first configuration and a second configuration, said first configuration comprising the magnet affixed in a stationary manner in the rail path and the braking element connected to the upper platform/seat of the vehicle, and said second configuration comprising the braking element affixed in a stationary manner in the rail path and the magnet connected to the upper platform/seat, whereby the magnetic system includes a decelerating impulse that causes the upper platform/seat to rotate freely in relation to the carriage with angular momentum while the vehicle is gravitationally driven in linear motion.

2. Vehicle according to claim 1, wherein the magnetic system is program-controlled as a function of the position of the vehicle or it can be activated by a passenger.

3. Vehicle according to claim 2, wherein the magnet is a permanent magnet.

4. Vehicle according to claim 2, wherein the magnet is an electromagnet, whose excitation coil is fed in controlled fashion.

5. Vehicle according to claim 1, wherein the magnet is a permanent magnet.

6. Vehicle according to claim 5, wherein the magnet has two pole shoes, which form an air gap through which the braking element is guided.

7. Vehicle according to claim 6, wherein the magnet can be moved out of the path of the braking element, preferably by swiveling.

8. Vehicle according to claim 6, wherein the magnet, or magnets, occupy a stationary position in the area of the rail track and a disk or a ring is positioned as a braking element, preferably on the underside of the upper part of the vehicle.

9. Vehicle according to claim 5, wherein the magnet can be moved out of the path of the braking element, preferably by swiveling.

10. Vehicle according to claim 9, wherein the magnet, or magnets, occupy a stationary position in the area of the rail track and a disk or a ring is positioned as a braking element, preferably on the underside of the upper part of the vehicle.

11. Vehicle according to claim 1, wherein the magnet is an electromagnet, whose excitation coil is fed in controlled fashion.

12. Vehicle according to claim 11, wherein the magnet, or magnets, occupy a stationary position in the area of the rail track and a disk or a ring is positioned as a braking element, preferably on the underside of the upper part of the vehicle.

13. Vehicle according to claim 1, wherein the magnet, or magnets, occupy a stationary position in the area of the rail track and a disk or a ring is positioned as a braking element, preferably on the underside of the upper part of the vehicle.

14. Vehicle according to claim 13, wherein the disk or ring is circular or oval in shape.

15. Vehicle according to claim 14, wherein the disk exhibits radially projecting segments.

16. Vehicle according to claim 14, wherein the disk or ring is positioned eccentric to the rotating axis of the upper part.

17. Vehicle according to claim 16, wherein the disk or ring is so designed, and the magnets so positioned in certain rail sections, that the upper part has a predefined orientation.

18. Vehicle according to claim 14, wherein the disk or ring exhibits indentations.

19. Vehicle according to claim 18, wherein the disk or ring is so designed, and the magnets so positioned in certain rail sections, that the upper part has a predefined orientation.

20. Vehicle according to claim 13, wherein the disk or ring is so designed, and the magnets so positioned in certain rail sections, that the upper part has a predefined orientation.

* * * * *